US012179896B2

(12) United States Patent
Crawford et al.

(10) Patent No.: US 12,179,896 B2
(45) Date of Patent: Dec. 31, 2024

(54) COMBINED TRIM AND STEERING TROLLING MOTOR SYSTEM

(71) Applicant: NAVICO, INC., Tulsa, OK (US)

(72) Inventors: Christopher D. Crawford, Bixby, OK (US); Peter Ver Brugge, Seattle, WA (US); Blaine Kuehmichel, Wausau, WI (US)

(73) Assignee: Navico, Inc., Tulsa, OK (US)

( * ) Notice: Subject to any disclaimer, the term of this patent is extended or adjusted under 35 U.S.C. 154(b) by 570 days.

(21) Appl. No.: 17/490,144

(22) Filed: Sep. 30, 2021

(65) Prior Publication Data

US 2023/0102255 A1 Mar. 30, 2023

(51) Int. Cl.

| | |
|---|---|
| ***B63H 20/00*** | (2006.01) |
| ***B63H 20/10*** | (2006.01) |
| ***B63H 20/12*** | (2006.01) |

(52) U.S. Cl.

CPC ..... *B63H 20/007* (2013.01); *B63H 20/10* (2013.01); *B63H 20/106* (2013.01); *B63H 20/12* (2013.01)

(58) Field of Classification Search

CPC .... B63H 20/007; B63H 20/10; B63H 20/106; B63H 20/12

See application file for complete search history.

(56) References Cited

U.S. PATENT DOCUMENTS

| | | | | |
|---|---|---|---|---|
| 6,431,923 | B1 * | 8/2002 | Knight | B63H 25/42 440/6 |
| 9,160,210 | B2 * | 10/2015 | Perry | H02K 7/116 |
| 9,296,455 | B2 * | 3/2016 | Bernloehr | B63H 21/17 |
| 11,203,311 | B2 * | 12/2021 | Fujino | H01R 35/02 |
| 11,465,724 | B1 * | 10/2022 | Jackson | B63H 20/007 |
| 2009/0163090 | A1 | 6/2009 | Heromin | |
| 2017/0158297 | A1 | 6/2017 | Sampson | |

OTHER PUBLICATIONS

"Repairing your own clockspring—not easy, but satisfying" dated Feb. 19, 2012, accessed from https://gmtnation.com/forums/threads/repairing-your-own-clockspring-not-easy-but-satisfying.1940/ on Dec. 17, 2021, all enclosed pages cited.

(Continued)

*Primary Examiner* — Ajay Vasudeva

(74) *Attorney, Agent, or Firm* — Nelson Mullins Riley & Scarborough LLP

(57) ABSTRACT

A trolling motor is provided for attachment to a watercraft. The trolling motor includes a system for steering and trimming a trolling motor. The system includes a trolling motor shaft attachment feature configured to receive and rotate with a trolling motor shaft about a trolling motor shaft axis. The system further includes a steering system having a steering motor configured to rotate the shaft attachment feature and shaft to steer a facing direction of the trolling motor. The trim system includes a trim module having a trim motor configured to cause the trolling motor shaft to raise or lower with respect to the steering system so as to cause the trolling motor to raise or lower with respect to the watercraft. The trim module is disposed on the shaft attachment feature such that the trim module rotates with the trolling motor shaft attachment feature about the shaft axis.

19 Claims, 17 Drawing Sheets

(56) References Cited

OTHER PUBLICATIONS

"The Less is More Approach to Robotic Cable Management" dated May 1, 2018, accessed from https://www.techbriefs.com/component/content/article/tb/pub/features/articles/28862 on Dec. 17, 2021, all enclosed pages cited.

"Garmin Force Freshwater Trolling Motor—50" [010-02024-00] accessed from https://mygreenoutdoors.com/garmin-force-freshwater-trolling-motor-50-010-02024-00/?msclkid=d4acbecb07c8141c5754df0bcd5f7f6c&utm_source=bing&utm_medium=cpc&utm_campaign=Shopping%20-%20Garmin%20(Med)&utm_term=4582077274501825&utm_content-Garmin on Dec. 20, 2021, all enclosed pages cited.

"Minn Kota 54" Trim Module Assembly SW 2887808 accessed from https://northlandmarine.com/products/minn-kota-54-trim-module-assembly-sw-2887808 on Dec. 20, 2021, all enclosed pages cited.

"Minn Kota Ulterra 80 Trolling Motor w/iPilot & Bluetooth—24V-80lb-60" [1358920] accessed from https://mygreenoutdoors.com/minn-kota-ulterra-80-trolling-motor-w-ipilot-bluetooth-24v-801b-60-1358920/?msclkid=86a90b4953311ff41fd66a89998a67a4&utm_source=bing&utm_medium=cpc&utm_campaign=Shopping%20-%20Minn%20Kota%20-%20Desktop%2FTablet%20(Medium)&utm_term=4581458797064031&utm_content=Minn%20Kota on Dec. 20, 2021, all enclosed pages attached.

* cited by examiner

COMBINED TRIM AND STEERING TROLLING MOTOR SYSTEM

FIELD OF THE INVENTION

Embodiments of the present invention relate generally to trolling motors, and more particularly, to systems for trim and steering a trolling motor.

BACKGROUND OF THE INVENTION

Trolling motor assemblies are often used during fishing or other marine activities. The trolling motor assembly attaches to the watercraft and propels the watercraft along a body of water. While trolling motor assemblies may be utilized as the main propulsion system of watercraft, trolling motor assemblies are often utilized to provide secondary propulsion or precision maneuvering that can be ideal for fishing activities. Typically, trolling motor assemblies include a small gas or electric trolling motor for providing thrust and a steering mechanism for changing the direction of the generated thrust. Trolling motor assemblies may also include a mechanism for changing the trim of the trolling motor, either electrically or manually.

BRIEF SUMMARY OF THE INVENTION

Electronic trim and steering systems of a trolling motor are typically in two distinct housings. In some trolling motor assemblies, the trim system is mounted on top of the steering system about the shaft of the trolling motor. The steering system and trim system are configured as two distinct units connected by a slip ring, or other similar device. The slip ring is designed to transfer power and data from the steering system to the trim system. However, due to the slip ring having exposure to water, environmental elements and other operating conditions, there is an increased likelihood of corrosion or deterioration of the slip ring.

In order to place the trim and steering systems in the same unit there needs to be an inventive design that accounts for the different aims of each system. Further, there needs to a reliable method of supplying and transferring power and data between the two individual systems.

Applicant has developed various example systems and methods, as detailed herein to combine the trim system and the steering system into a single sub-assembly and/or unit, while reliably providing power and data transferability between both the steering system and the trim system, and any additional systems outside of the system housing. Such a single sub-assembly and/or unit provides advantages for maintaining a minimal footprint, as well as enabling for improved sealing of the electronics needed to drive both systems.

In an example embodiment, a steering system and a trim system may be combined within a single system housing. Within the system housing there may be a shaft attachment feature defining a pathway through the system housing for receiving the trolling motor shaft. The shaft attachment feature may be configured to rotate with the trolling motor shaft about a shaft axis.

The combined system may include a steering system. The steering system may include a steering motor and a plurality of steering gears configured to rotate the shaft attachment feature about the shaft axis. The combined system may further include a trim system. The trim system may be configured to move the trolling motor shaft vertically along the shaft axis. The trim system may be positioned on the shaft attachment feature such that the trim system may rotate with the shaft attachment feature about the shaft axis.

The system housing may be watertight and may be shaped to accommodate the rotation of the trim system within the housing. The system housing may further include at least one opening to provide electrical and mechanical communication between the system and an outside source, for example, the watercraft and/or a mount of the trolling motor.

In some embodiments, a cable may be used to provide an electrical connection to the trim system. The cable may be configured to enter the system housing and descend below the steering system onto a bottom face of the shaft attachment feature. The cable may be configured in a spiral and, in some embodiments, biased by a guide path protruding from the bottom face of a steering gear of the shaft attachment feature. The guide path may include an opening between the steering gear and the elongated shaft portion of the shaft attachment feature, such that the cable may be guided though the opening to connect to the trim system.

In another example embodiment, the cable may be configured to crawl about the exterior of the trim system and the shaft attachment feature. The trim system may include an upper portion having an upper wall descending from the upper portion, and a lower portion having a lower wall ascending from the lower potion. Both the upper wall and lower walls may include an outer surface. In some embodiments, the cable may be reinforced to form a rigid exterior such that the cable may maintain its shape. The cable may include an upper segment, a middle segment, and a lower segment. As the system rotates the cable may crawl along the lower portion and the upper portion such that the length of the middle segment is constant, and the length of the upper and the lower segments are inversely proportional.

An example embodiment provides a system for steering and trimming a trolling motor comprising a trolling motor shaft attachment feature configured to receive and rotate with a trolling motor shaft about a motor shaft axis. The system comprises a steering system and a trim system. The steering system comprises a steering motor configured to rotate the trolling motor shaft attachment feature and the trolling motor shaft to steer a facing direction of the trolling motor. The trim system comprises a trim module having a trim motor configured to cause the trolling motor shaft to raise or lower with respect to the steering system so as to cause the trolling motor to raise or lower with respect to the watercraft. The trim module is disposed on the trolling motor shaft attachment feature such that the trim module rotates with the trolling motor shaft attachment feature about the trolling motor shaft axis.

In some embodiments, the trim module further comprises a gear train coupled to the trolling motor shaft attachment feature. The gear train is configured to move the trolling motor shaft along the trolling motor shaft axis with respect to the trim module and the trolling motor attachment feature. The gear train may include a worm gear.

In some embodiments, the steering system is in mechanical connection with the trolling motor shaft attachment feature. In some embodiments, the trim system is in electrical connection with the steering system.

In some embodiments, the system comprises a housing. The housing encloses the trolling motor shaft attachment feature, the steering system and the trim system. The trolling motor shaft attachment feature is configured to rotate with the shaft within the housing.

In some embodiments, the system includes a cable to provide an electrical connection between the trim system and a device or system external to the housing. In some embodiments, the cable further provides electrical connection to the steering system. In some embodiments, the cable further provides electrical connection between the trim system and the steering system.

In some embodiments, the trolling motor shaft attachment feature further comprises a guide path for the cable. The guide path is disposed on a bottom face of the trolling motor shaft attachment feature, and the trim module is disposed on a top face of the trolling motor shaft attachment feature in some embodiments. In some embodiments, the guide path is configured as a spiral. The cable is be rotatable between a relaxed position and a tightened position. The rotation of the trolling motor shaft in a first direction tightens the cable, and rotation in a second direction, opposite the first direction loosens the cable.

In some embodiments, the trim system further comprises an upper surface about an upper portion of the trim system, and a lower surface about a lower portion of the trim system. The cable has an upper segment disposed about the upper surface, a lower segment disposed about the lower surface, and a middle segment disposed between the upper surface and the lower surface. Each segment of the cable may have a length. The upper segment has a first length, the lower segment has a second length, and the middle segment has a third length. In some embodiments, the first and second lengths are inversely proportional, and the third length is constant, as the trolling motor shaft attachment feature rotates. In some embodiments, the cable comprises a rigid outer layer.

In another example embodiment, a trolling motor assembly for attachment to a watercraft comprises a shaft having a first end and a second end defining a shaft axis extending between the first end and the second end. The assembly further comprises a trolling motor at least partially contained within a trolling motor housing. The trolling motor housing is attached to the second end of the shaft, such that when the trolling motor assembly is attached to the watercraft and the trolling motor housing is submerged in a body of water, the trolling motor, when operating, is configured to propel the watercraft to travel along the body of water. The trolling motor assembly further comprises a main housing connected to the shaft proximate the first end of the shaft. The main housing is configured to be positioned out of the body of water when the trolling motor assembly is attached to the watercraft and the trolling motor housing is submerged in the body of water. The trolling motor assembly further comprises a trolling motor shaft attachment feature configured to rotate with the shaft.

The trolling motor assembly further comprises a steering system and a trim system. The steering system comprises a steering motor configured to rotate the trolling motor shaft attachment feature and the trolling motor shaft to steer a facing direction of the trolling motor. The trim system comprises a trim module configured to cause the shaft to raise or lower with respect to the steering system so as to cause the trolling motor housing to raise or lower with respect to the watercraft. The trim module is disposed on the trolling motor shaft attachment feature such that the trim module rotates with the trolling motor shaft attachment feature about the shaft axis.

In some embodiments, the assembly further comprises a system housing. The system housing encloses the trolling motor shaft attachment feature, the steering system and the trim system. The trolling motor shaft attachment feature is configured to rotate with the shaft within the system housing. In some embodiments, the system housing is watertight.

In some embodiments, the trolling motor shaft attachment feature further comprises a spiral guide path disposed on an underside. A cable is disposed within the spiral guide path configured to loosen and tighten within the guide path as the trolling motor shaft attachment feature rotates about the shaft.

In some embodiments, the trim system further comprises an upper surface about an upper portion of the trim system, and a lower surface about a lower portion of the trim system. A cable disposed about the trim system has an upper segment disposed about the upper surface, a lower segment disposed about the lower surface, and a middle segment disposed between the upper surface and the lower surface. Each segment of the cable may have a length. The upper segment has a first length, the lower segment has a second length, and the middle segment has a third length. In some embodiments, the first and second lengths are inversely proportional, and the third length is constant, as the trolling motor shaft attachment feature rotates. In some embodiments, the cable comprises a rigid outer layer.

In yet another example embodiment, a method for steering and trimming a trolling motor is provided. The method comprises providing a trolling motor assembly for attachment to a watercraft. The trolling motor assembly comprises a shaft having a first end and a second end defining a shaft axis extending between the first end and the second end. The assembly further comprises a trolling motor at least partially contained within a trolling motor housing. The trolling motor housing is attached to the second end of the shaft, such that when the trolling motor assembly is attached to the watercraft and the trolling motor housing is submerged in a body of water, the trolling motor, when operating, is configured to propel the watercraft to travel along the body of water. The trolling motor assembly further comprises a main housing connected to the shaft proximate the first end of the shaft. The main housing is configured to be positioned out of the body of water when the trolling motor assembly is attached to the watercraft and the trolling motor housing is submerged in the body of water. The trolling motor assembly further comprises a trolling motor shaft attachment feature configured to rotate with the shaft.

The trolling motor assembly further comprises a steering system and a trim system. The steering system comprises a steering motor configured to rotate the trolling motor shaft attachment feature and the trolling motor shaft to steer a facing direction of the trolling motor. The trim system comprises a trim module configured to cause the shaft to raise or lower with respect to the steering system so as to cause the trolling motor housing to raise or lower with respect to the watercraft. The trim module is disposed on the trolling motor shaft attachment feature such that the trim module rotates with the trolling motor shaft attachment feature about the shaft axis.

In some embodiments, the method further comprises causing the steering system to operate to cause the trolling motor shaft attachment feature and the shaft to change the facing direction of the trolling motor. The method further comprises causing the trim system to operate to cause the shaft to raise or lower with respect to the steering system so as to cause the trolling motor to raise or lower with respect to the watercraft.

In some embodiments, the trolling motor assembly for use with the method may further comprise a system housing, wherein the system housing encloses the trolling motor shaft attachment feature, the steering system and the trim system, wherein the trolling motor shaft attachment feature is configured to rotate with the shaft within the system housing.

BRIEF DESCRIPTION OF THE DRAWINGS

Figure 1:
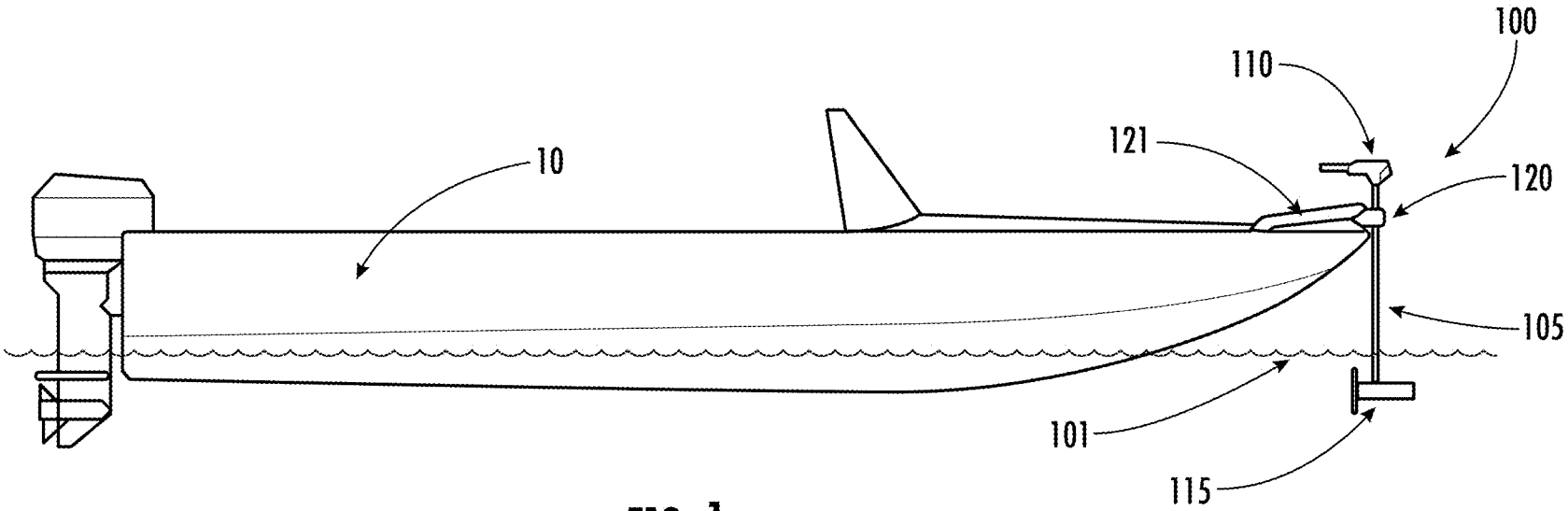
Figure 2:
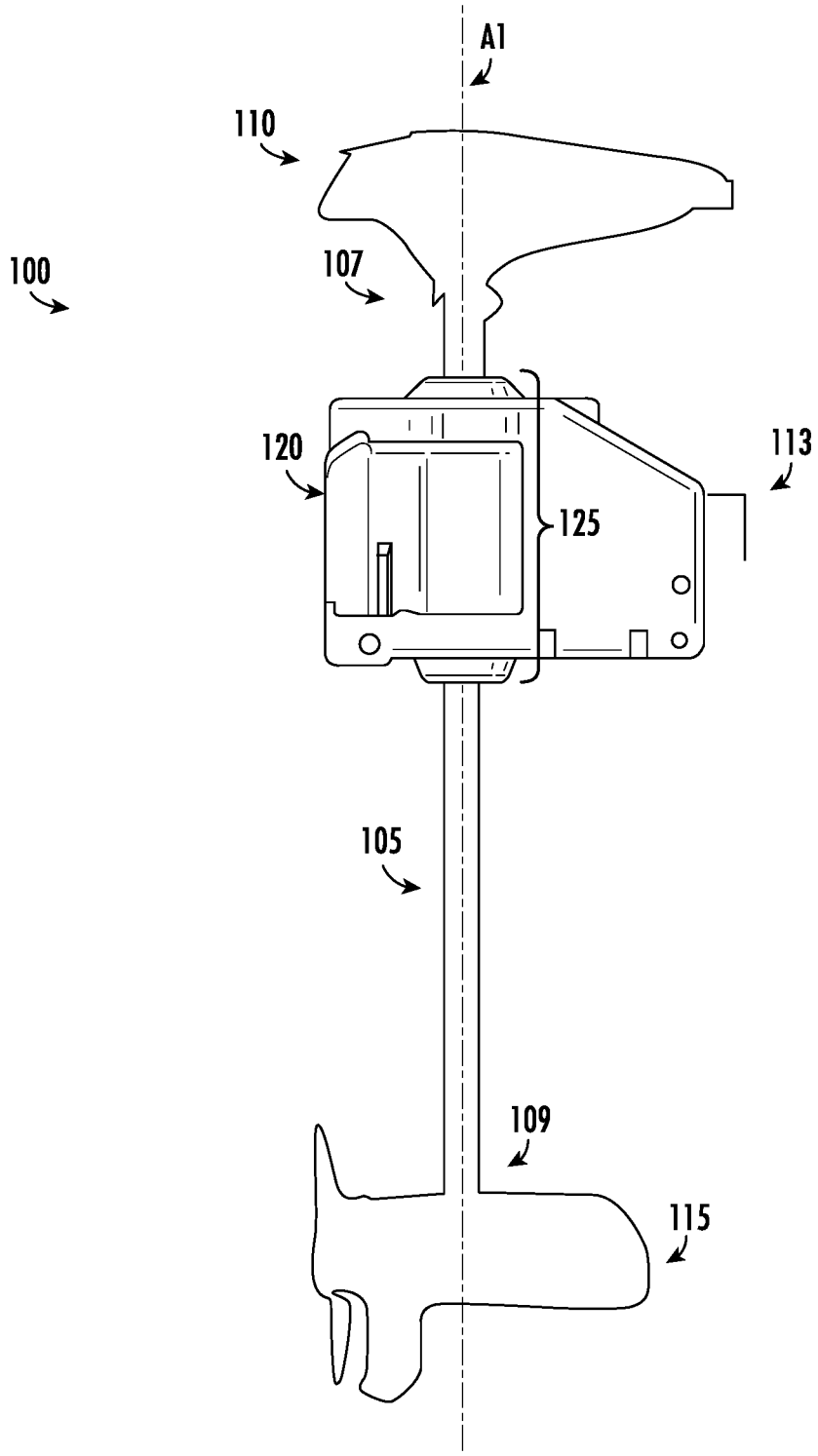
Figure 3:
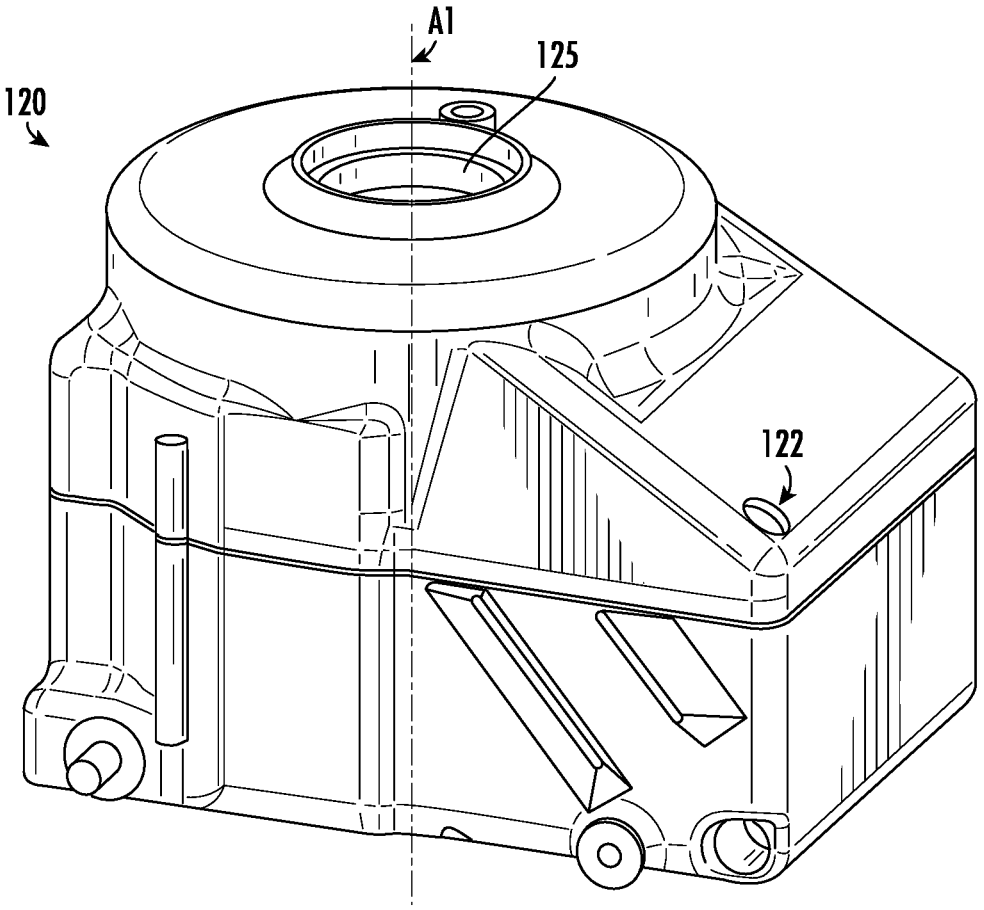
Figure 4:
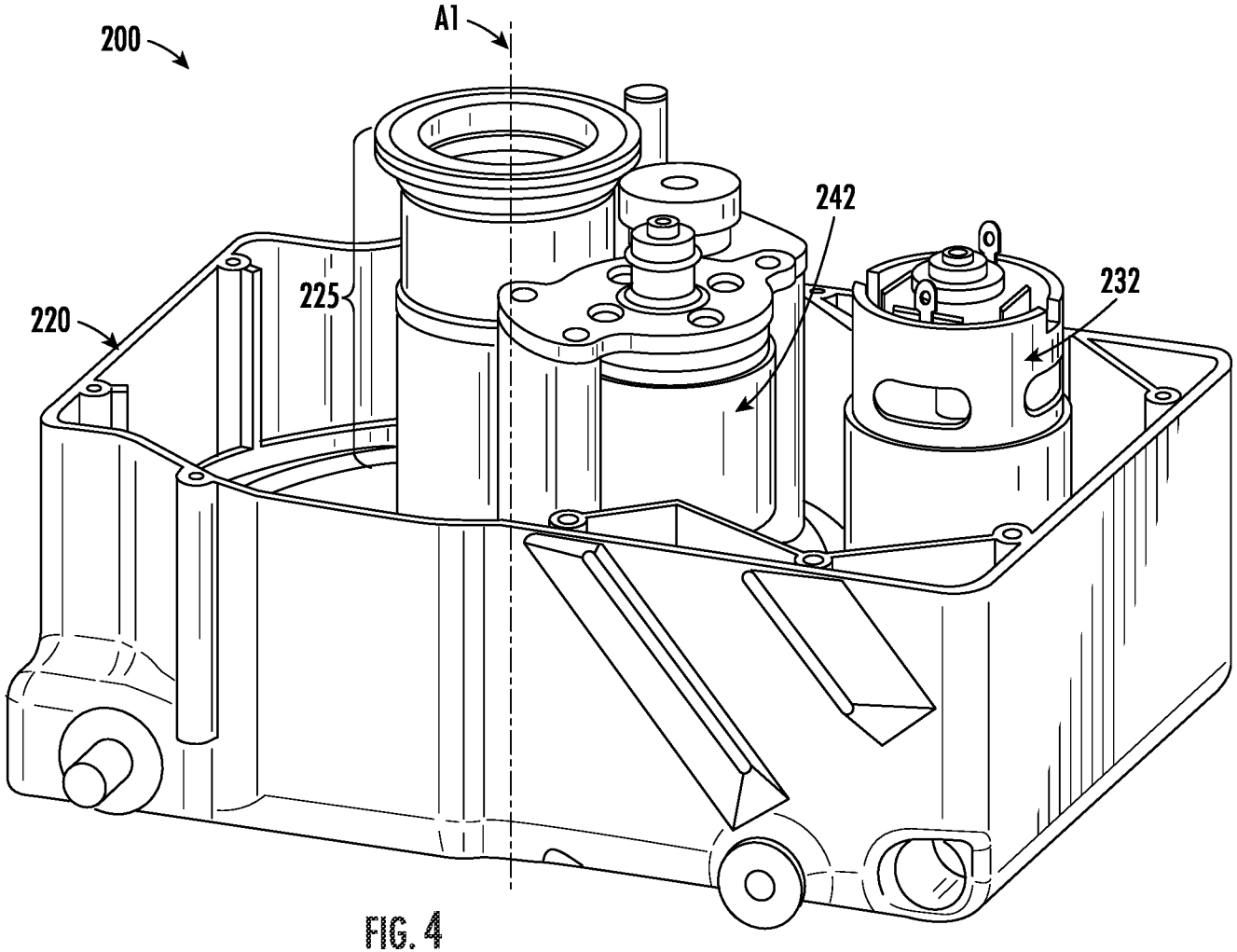
Figure 5A:
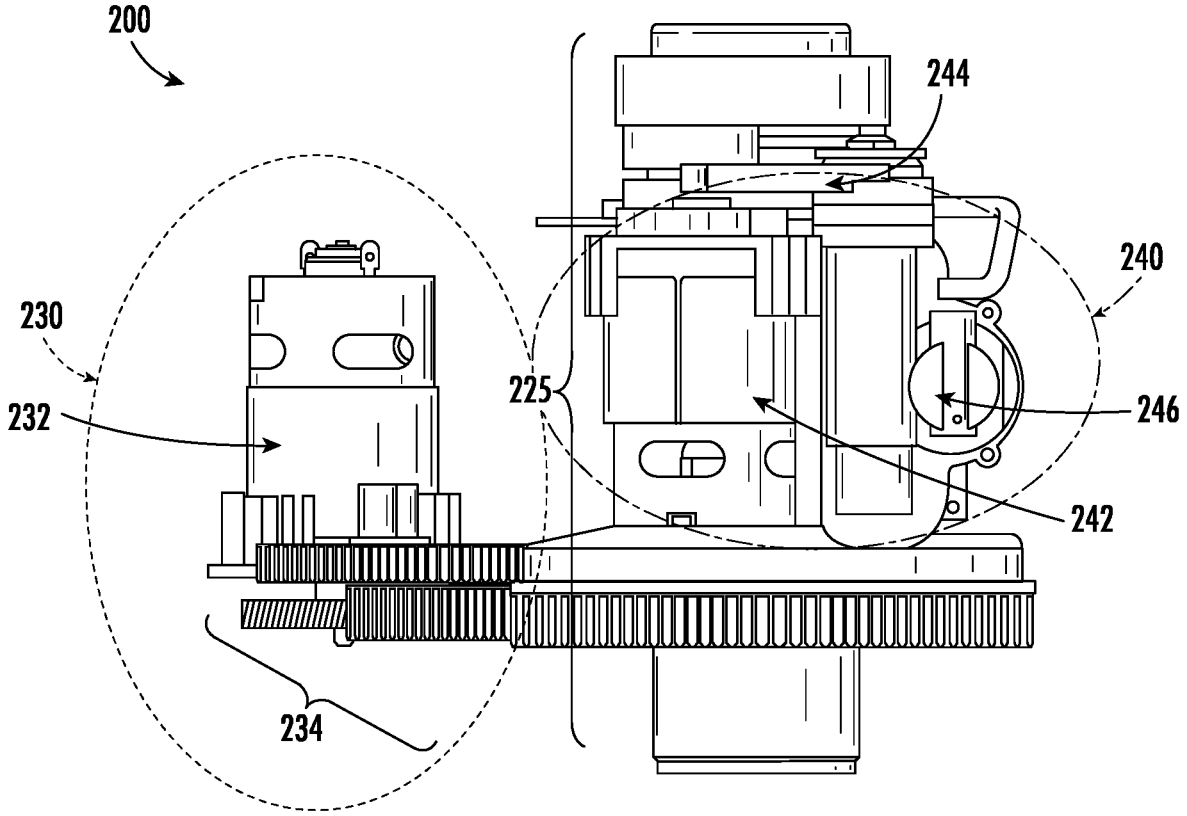
Figure 5B:
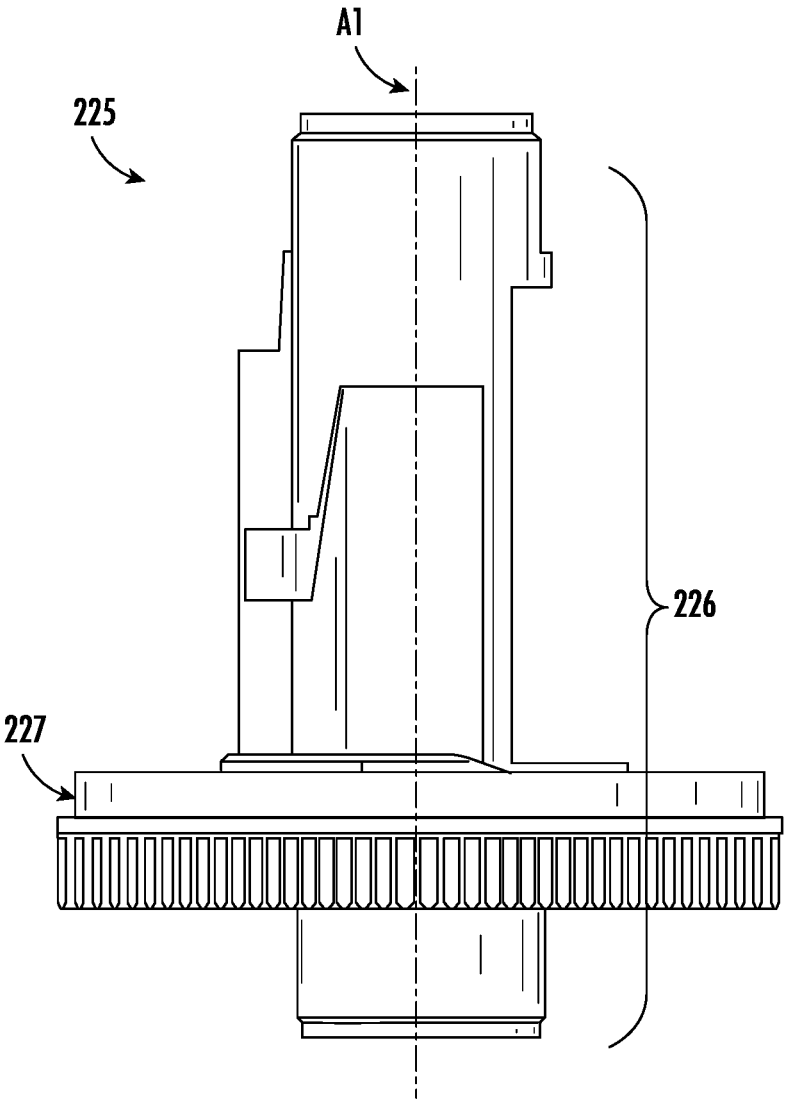
Figure 5C:
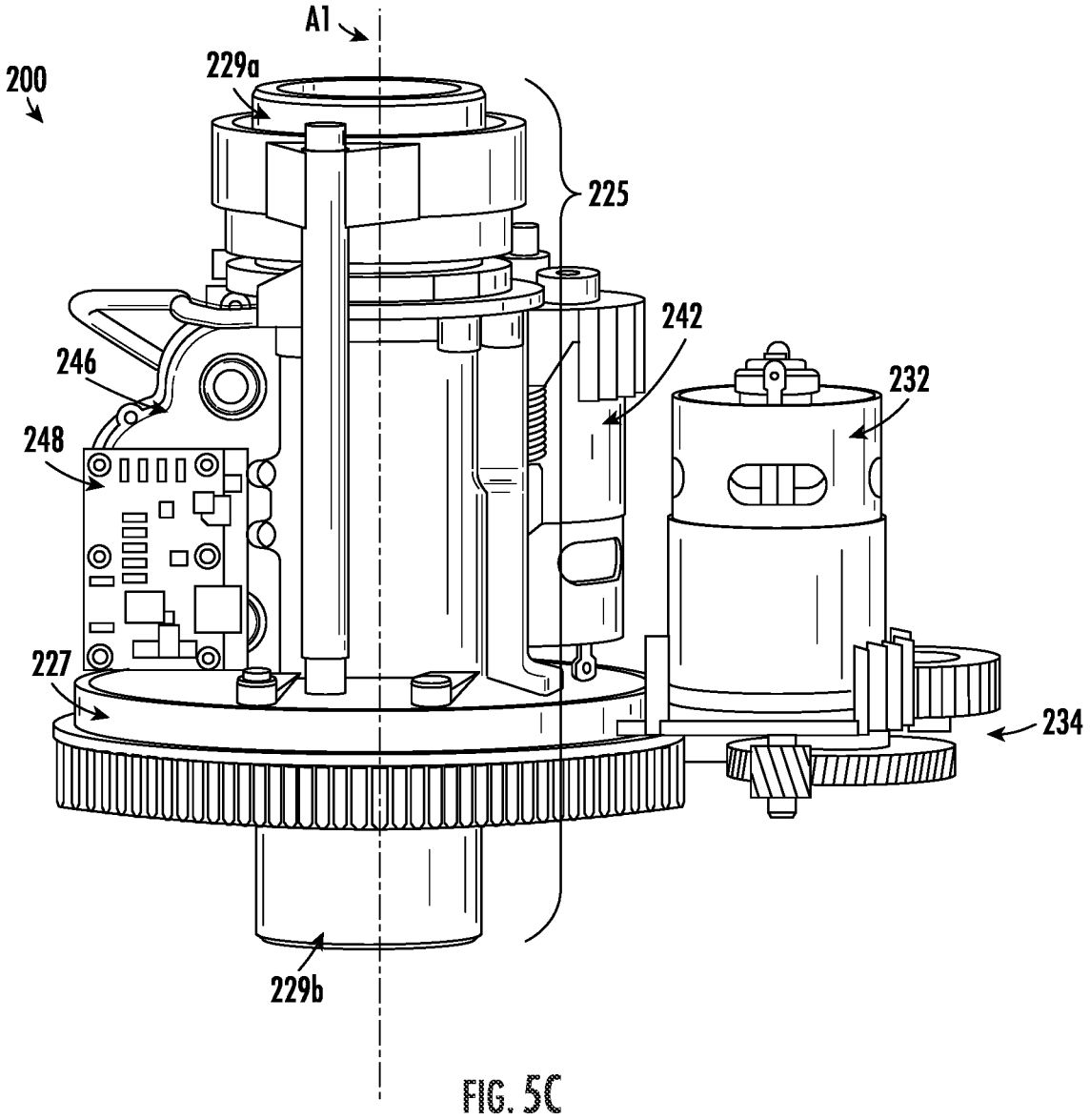
Figure 5D:
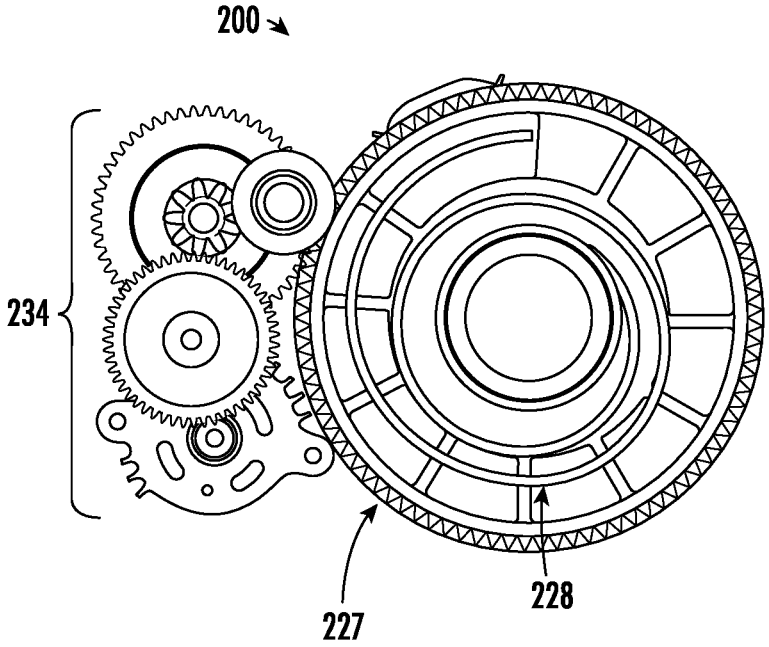
Figure 5E:
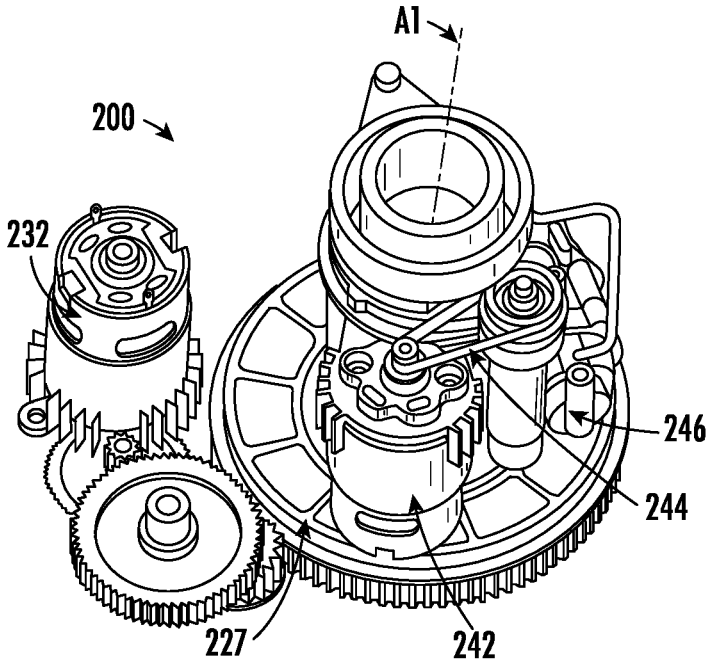
Figure 6:
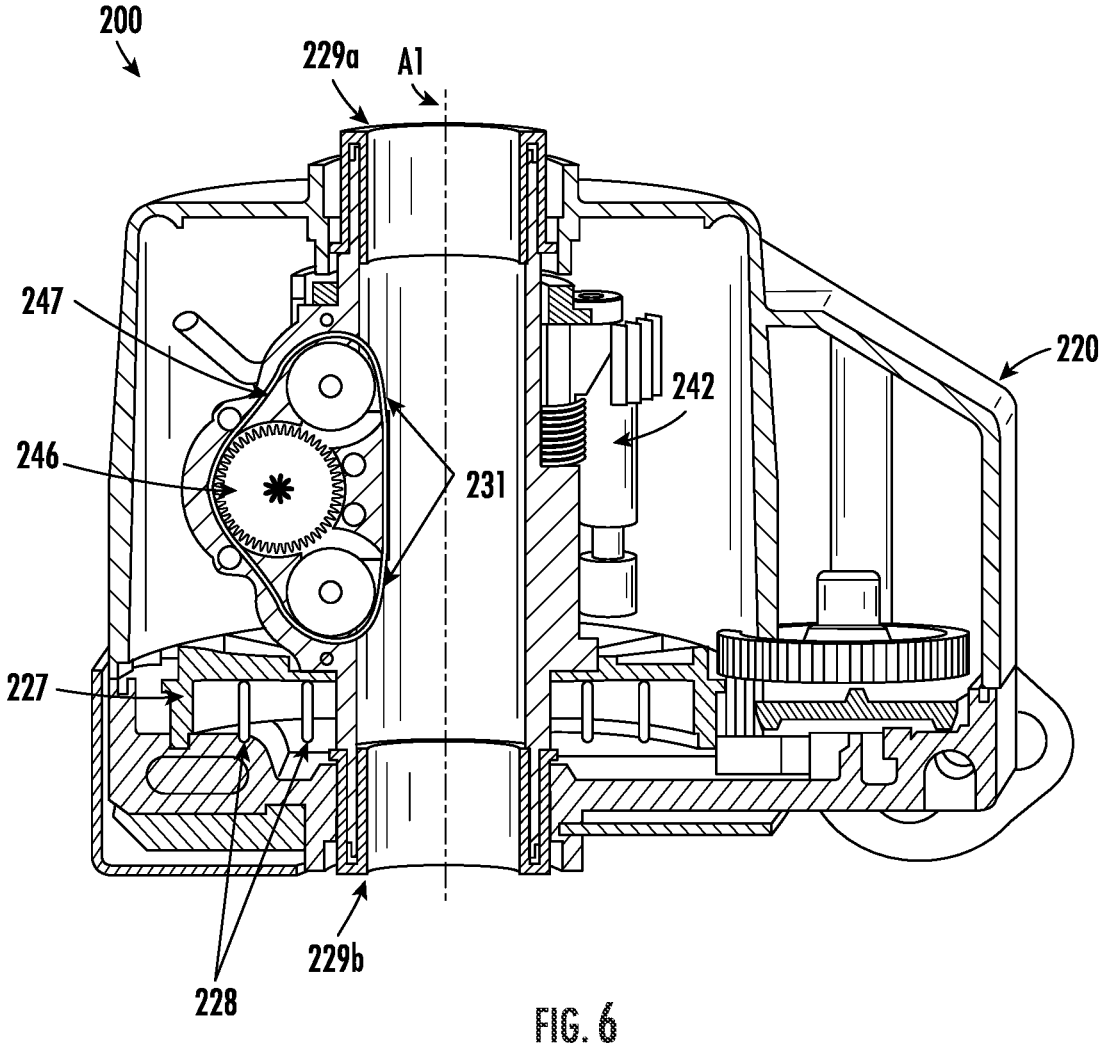
Figure 7A:
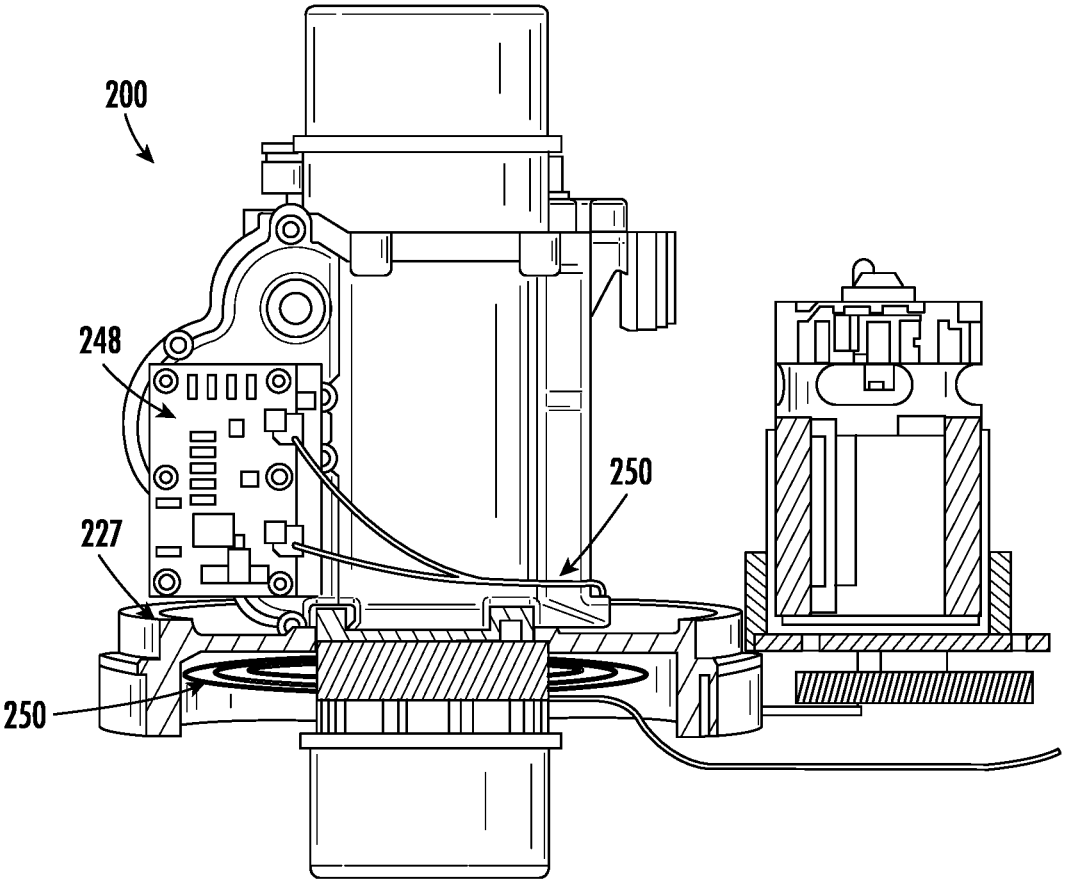
Figure 7B:
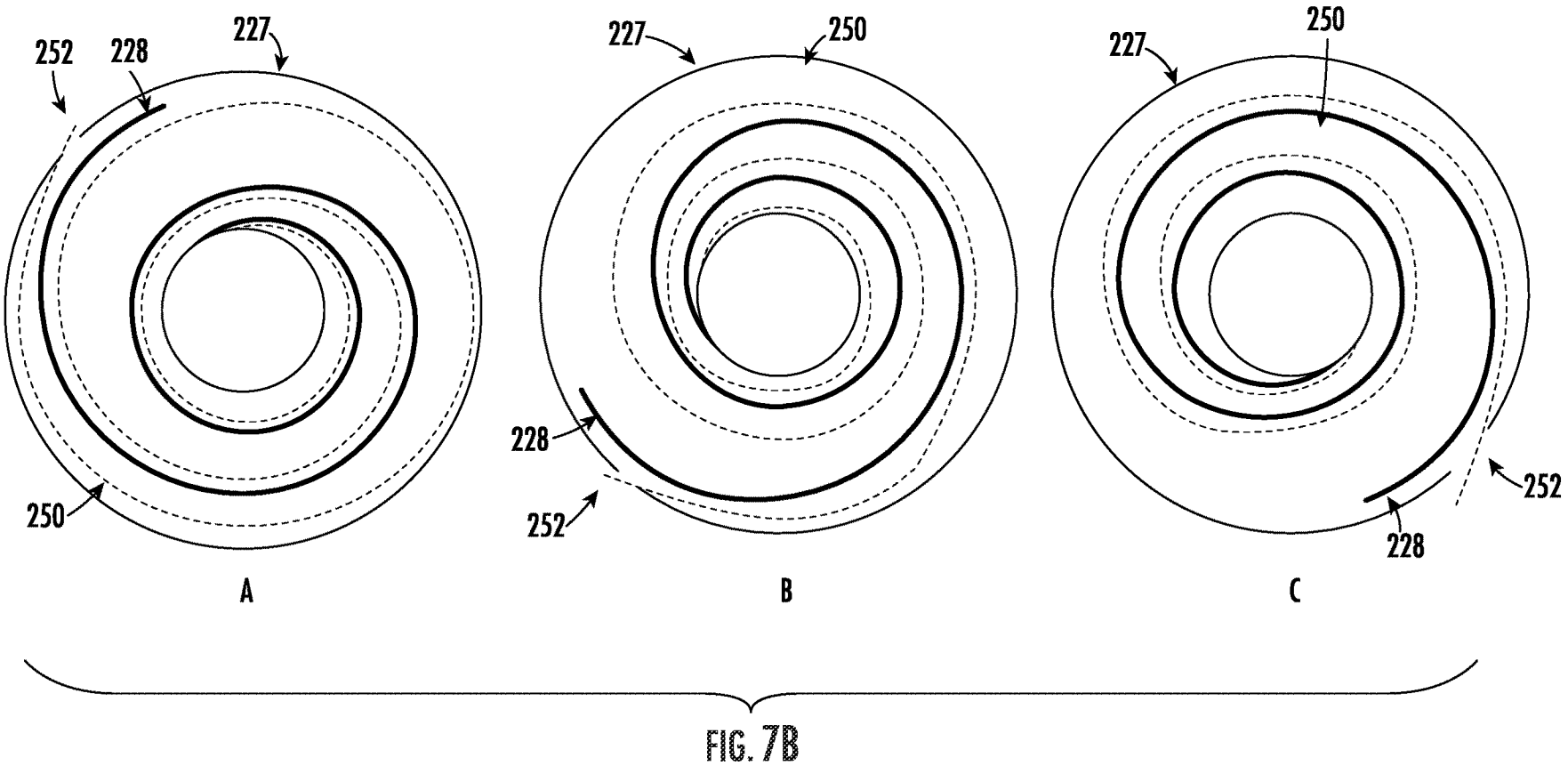
Figure 7C:
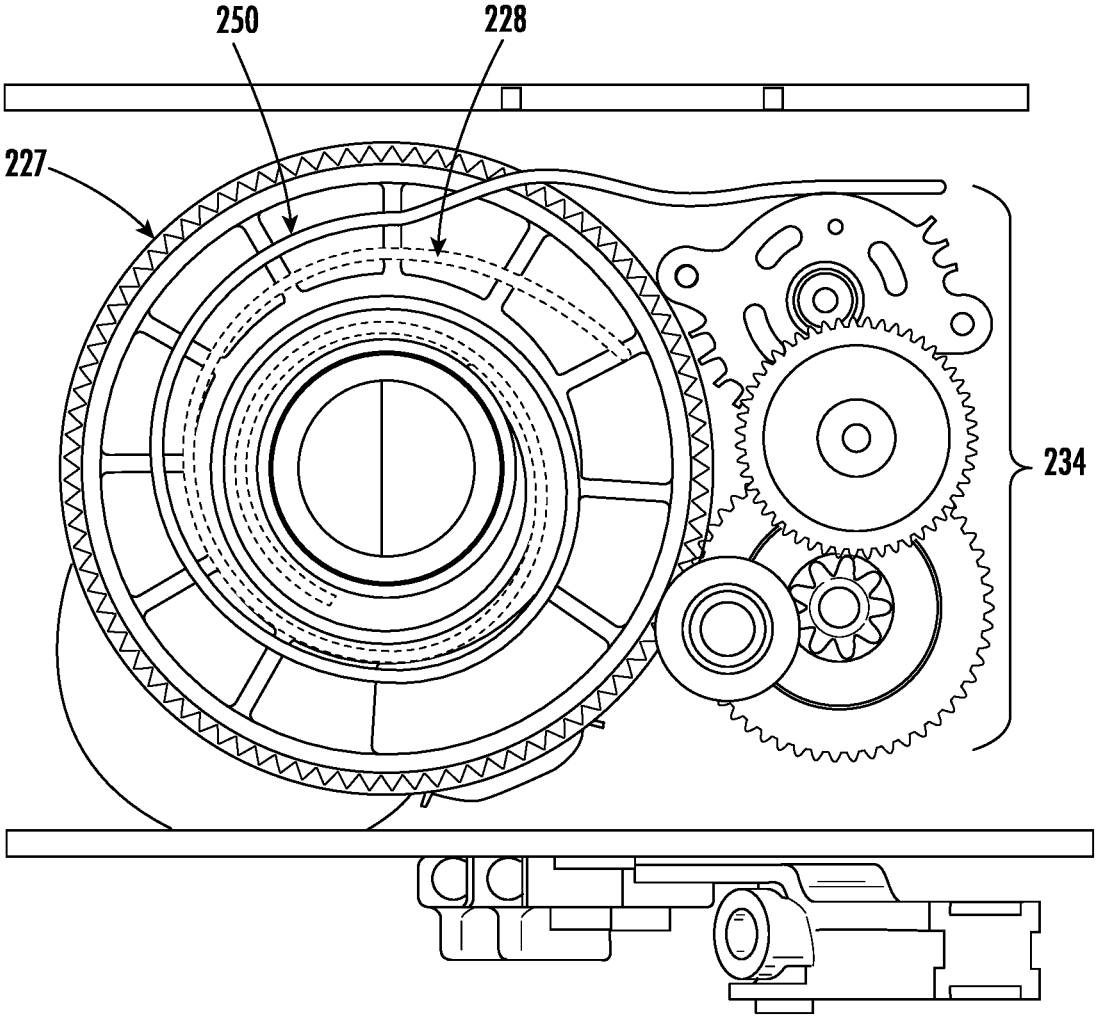
Figure 8A:
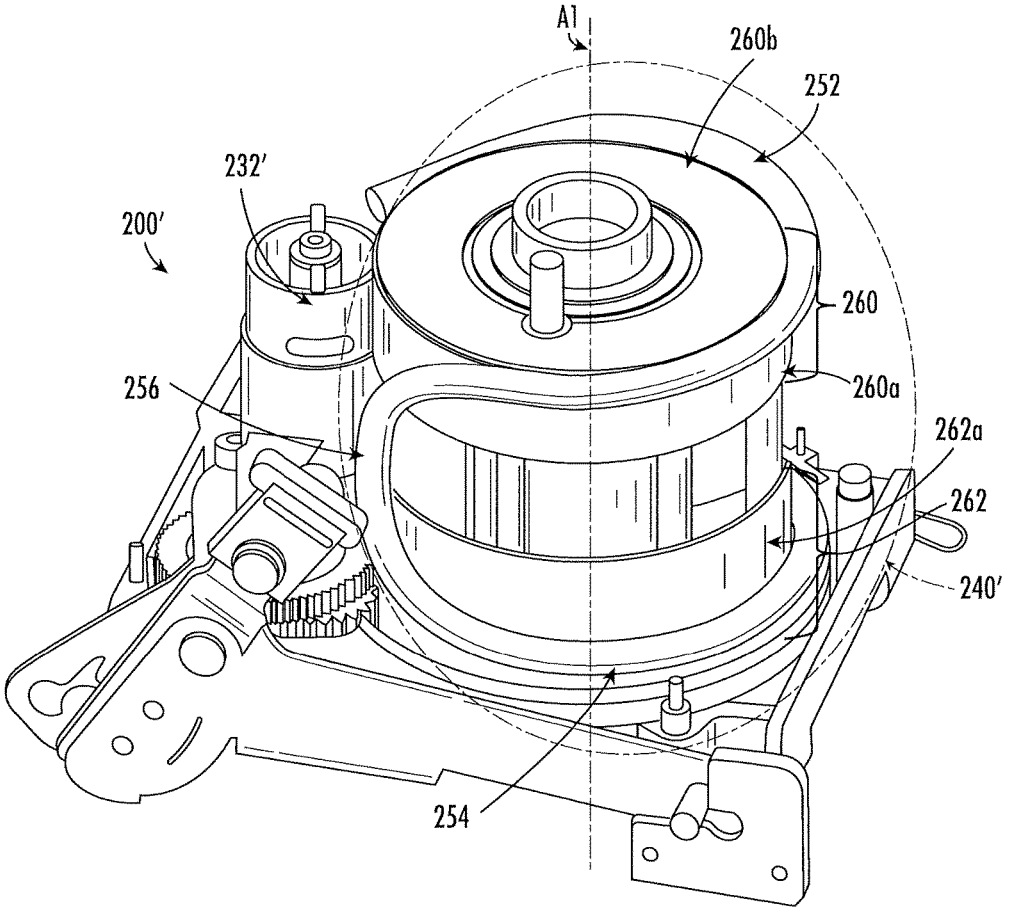
Figure 8B:
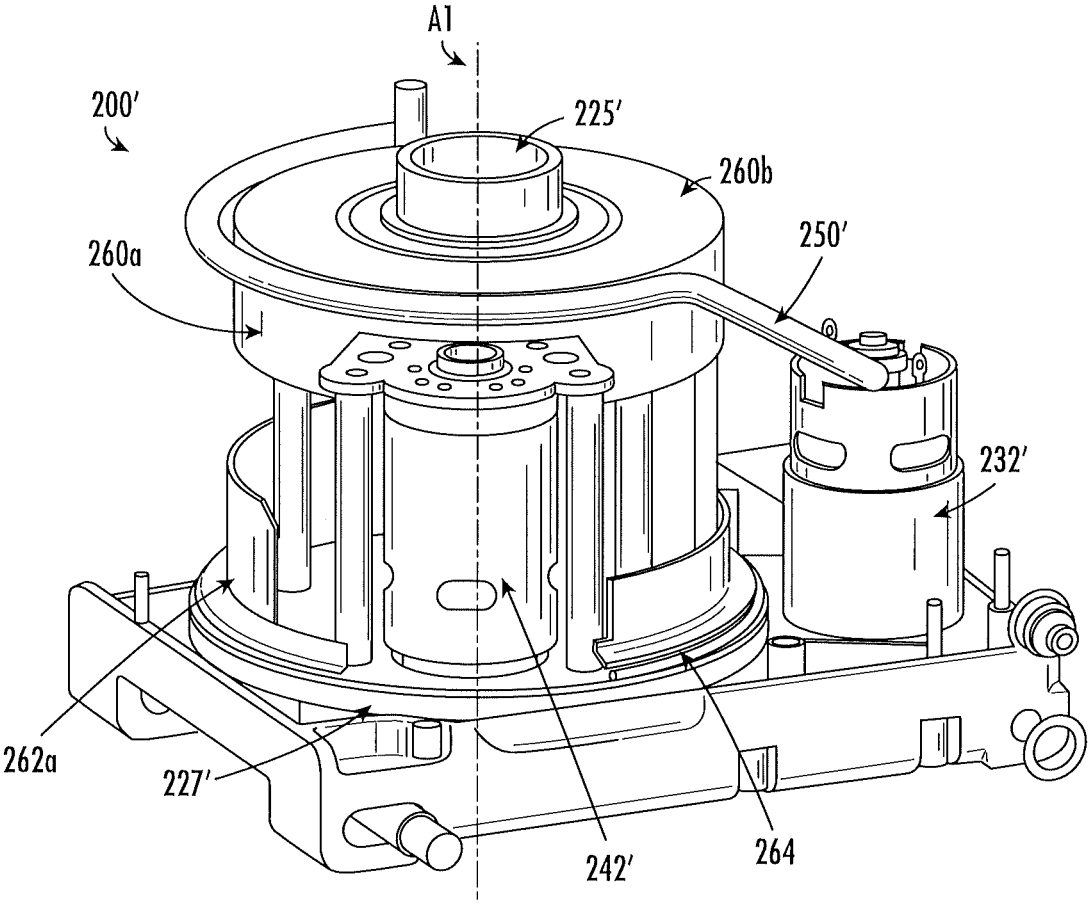
Figure 8C:
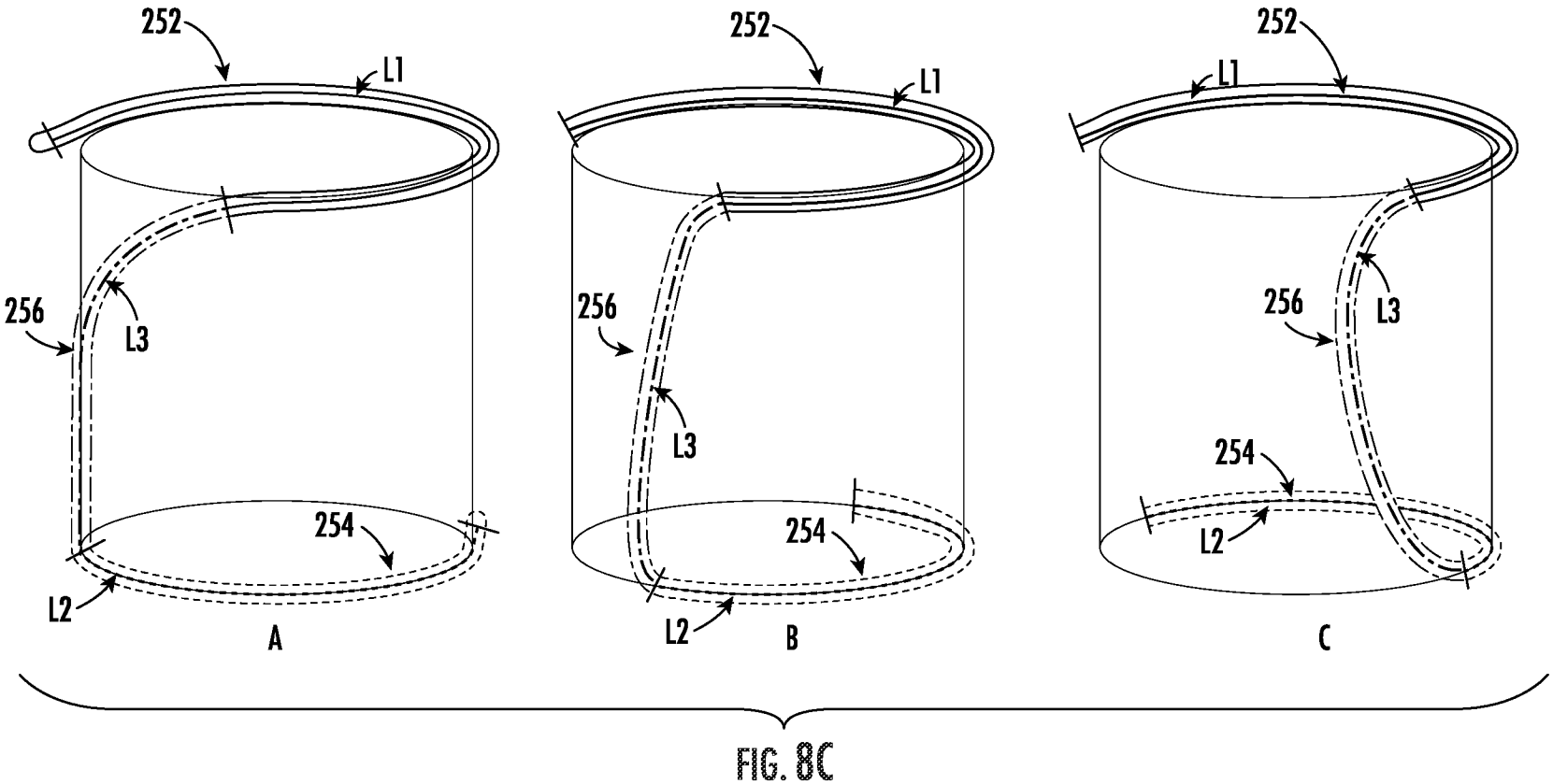
Figure 9:
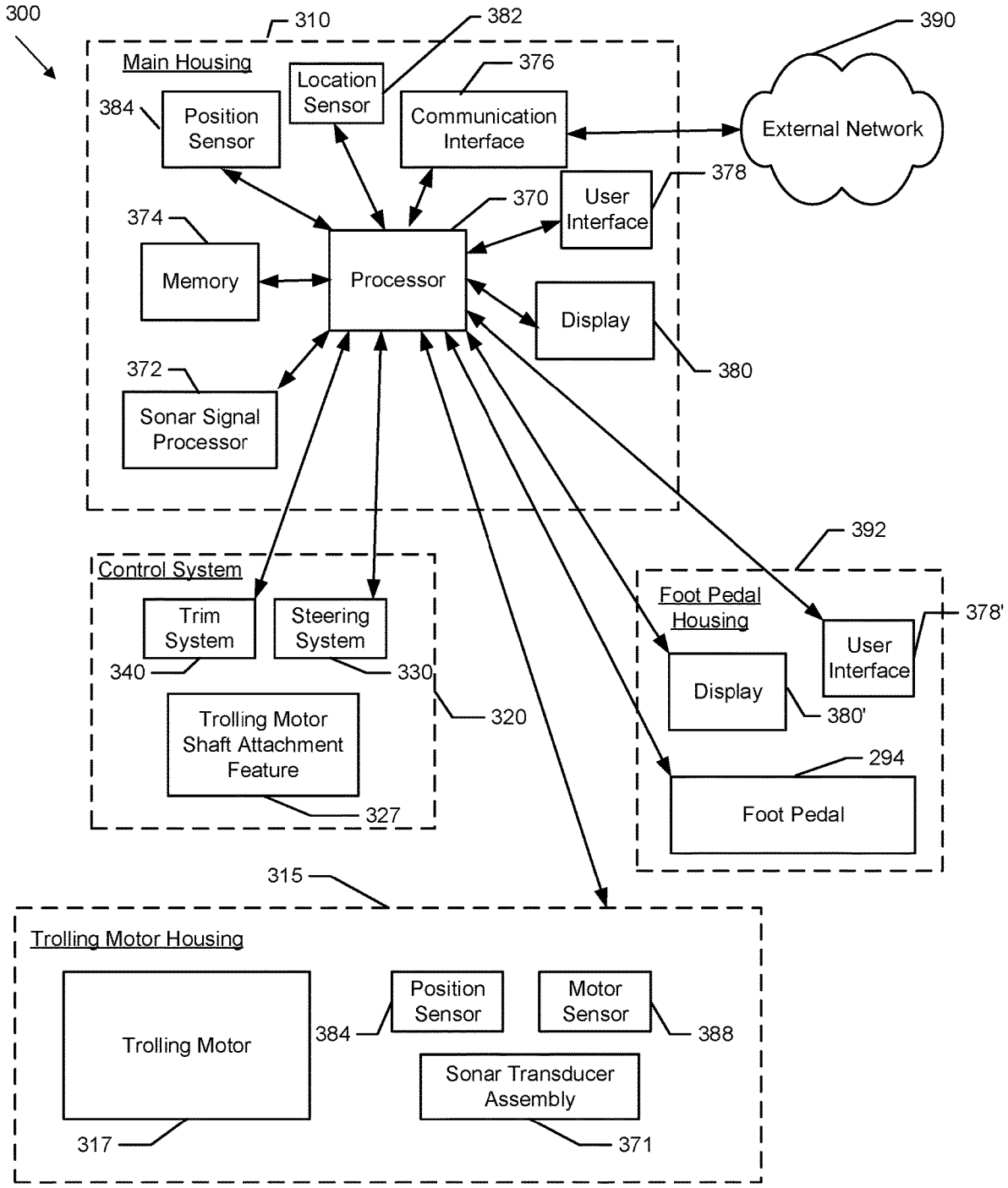
Figure 10:
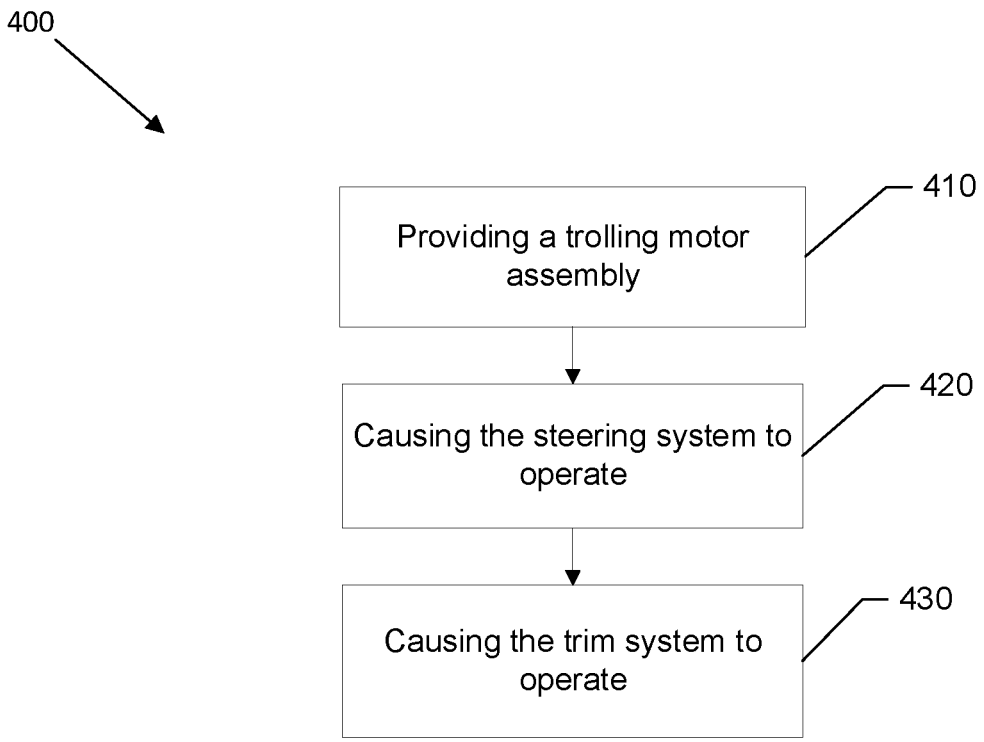

Having thus described the invention in general terms, reference will now be made to the accompanying drawings, which are not necessarily drawn to scale, and wherein:

FIG. 1 illustrates an example trolling motor assembly attached to a front of a watercraft, in accordance with some embodiments discussed herein;

FIG. 2 illustrates an example trolling motor assembly, in accordance with some embodiments discussed herein;

FIG. 3 illustrates an example combined trim and steering system housing, in accordance with some embodiments discussed herein;

FIG. 4 illustrates a perspective view of the example system housing with a portion of the system housing removed showing an example combined trim and steering system contained within the system housing, in accordance with some embodiments discussed herein;

FIG. 5A illustrates a first view of the example combined trim and steering system, in accordance with some embodiments discussed herein;

FIG. 5B illustrates an example trolling motor attachment feature, in accordance with some embodiments discussed herein;

FIG. 5C illustrates a second view of the example combined trim and steering system, in accordance with some embodiments discussed herein;

FIG. 5D illustrates a bottom view of the example combined trim and steering system, in accordance with some embodiments discussed herein;

FIG. 5E illustrates a top perspective view of the example combined trim and steering system, in accordance with some embodiments discussed herein;

FIG. 6 illustrates a cross-sectional view of the system housing containing the combined trim and steering system, in accordance with some embodiments discussed herein;

FIG. 7A illustrates a partial cross-sectional view of the combined trim and steering system, showing a cable configuration within the system, in accordance with some embodiments discussed herein;

FIG. 7B illustrates example rotation of the cable as the trolling motor rotates, in accordance with some embodiments discussed herein;

FIG. 7C illustrates a bottom view of an example cable configuration of the combined trim and steering system, in accordance with some embodiments discussed herein;

FIG. 8A illustrates a first perspective view of another example cable configuration for an example combined trim and steering system, in accordance with some embodiments discussed herein;

FIG. 8B illustrates a second perspective view of the example cable configuration shown in FIG. 8A, in accordance with some embodiments discussed herein;

FIG. 8C illustrates example rotation of the cable in the cable configuration shown in FIG. 8A as the trolling motor rotates, in accordance with some embodiments discussed herein;

FIG. 9 shows a block diagram illustrating a marine system including an example trolling motor assembly, in accordance with some embodiments discussed herein; and FIG. 10 illustrates a flowchart of an example method for operating the combined trim and steering system, in accordance with some embodiments discussed herein.

DETAILED DESCRIPTION

Example embodiments of the present invention now will be described more fully hereinafter with reference to the accompanying drawings, in which some, but not all embodiments of the invention are shown. Indeed, the invention may be embodied in many different forms and should not be construed as limited to the example embodiments set forth herein; rather, these embodiments are provided so that this disclosure will satisfy applicable legal requirements. Like reference numerals refer to like elements throughout.

Some embodiments of the present invention provide trolling motor assemblies having an electronic steering component and an electronic trim component coupled within a watertight housing. FIG. 1 illustrates an example watercraft 100 on a body of water 101. The watercraft 10 has a trolling motor assembly 100 attached to its front by a trolling motor mount 121, with a trolling motor housing 115 submerged in the body of water 101. The trolling motor within the trolling motor housing 115, which may be gas-powered or electric, for example, may be used as a propulsion system to provide thrust so as to cause the watercraft 10 to travel along the surface of the water. The trolling motor assembly 100 may also include a main housing 110 positioned out of the water and at a top of a shaft 105. While the depicted embodiment shows the trolling motor assembly 100 attached to the front of the watercraft 10 and as a secondary propulsion system, example embodiments described herein contemplate that the trolling motor assembly 100 may be attached in any position on the watercraft 10 and/or may serve as the primary propulsion system for the watercraft 10.

In accordance with various aspects of the present teachings, the trolling motor assembly 100 depicted in the example embodiment of FIG. 1 may include a system housing 120 having a steering system for changing the angular orientation of the trolling motor 100 so as to change the direction of the trolling motor's thrust, thereby steering the watercraft 10. Notably, the system housing 120 also includes a trim system for changing the vertical position of the trolling motor housing 115 (e.g., by causing the trolling motor shaft 105 to raise or lower).

Depending on the design, a trolling motor may be gas-powered or electric. Moreover, steering may be accomplished, via foot control, or even through use of a remote control. Additionally, in some cases, an autopilot may operate the trolling motor autonomously.

FIG. 2 illustrates an example trolling motor assembly 100. The trolling motor assembly 100 may include a shaft 105 having a first end 107 and a second end 109 defining a trolling motor shaft axis A1 extending therebetween. The trolling motor assembly 100 may include a main housing 110 attached to the first end 107 of the shaft 105, and a trolling motor housing 115 attached to the second end 109 of the shaft 105. In some embodiments, when the trolling motor assembly 100 is attached to the watercraft and the trolling motor, or trolling motor housing is submerged in the water, the trolling motor is configured to propel the watercraft to travel along the body of water. In addition to containing the trolling motor, the trolling motor housing 115 may include other components described herein including, for example, a sonar transducer assembly and/or other sensors.

The main housing 110 is positioned outside of the water and is connected to the shaft 105 proximate the first end of the shaft 105. The main housing 110 may be configured to house components of the trolling motor assembly, such as may be used for processing marine or sensor data and/or controlling operation of the trolling motor among other things. For example, with reference to FIG. 9, depending on the configuration and features of the trolling motor assembly, the main housing 110 may contain, for example, one or more processors 370, memory 374, location sensor 382, position sensor 384, communication interface 376, user interface 378, or a display 380.

The trolling motor assembly 100 may further include a system housing 120 moveably fixed about the shaft 105 via a trolling motor shaft attachment feature 125. In some embodiments, components of the system housing 120 may be configured to rotate the shaft about the trolling motor shaft axis A1, and to move the shaft 105 vertically along the shaft axis A1 and through the shaft attachment feature 125. The system housing 120 may include a watercraft attachment feature 113 to enable connection or attachment to the watercraft 10 and/or the trolling motor mount 121. In some embodiments, the watercraft attachment feature 113 may allow for complete removal of the trolling motor assembly 100 from the watercraft 10, while, in other embodiments, the watercraft attachment feature 113 may allow for hinging movement such that the trolling motor assembly 100 may rotate about an attachment point such that the trolling motor housing 115 is removed from the water.

FIG. 3 illustrates a perspective view of the system housing 120. The system housing 120 may be a watertight unit. In some embodiments, the shaft attachment feature 125 may be substantially cylindrical in shape and may extend through the system housing 120 and be configured to receive a shaft. In some embodiments, the shaft attachment feature 125 may include a watertight seal about the shaft attachment feature on an upper surface of the system housing 120, and on a lower surface of the system housing 120. In some embodiments, the system housing 120 may also include at least one opening to provide electrical, data and/or other connections with the system contained within the system housing 120, and an electrical supply, or other supply feature contained outside of the system housing, for example, located on the watercraft 10 and/or within the trolling motor mount 121 or other part of the trolling motor assembly 100.

In some embodiments, the system housing may form a single unit and/or sub-assembly which encloses a combined system for steering and trimming a trolling motor. FIG. 4 illustrates a perspective view of an example combined trim and steering system 200 within the system housing 220, wherein a portion of the housing is removed to show the placement of the system within the housing.

The system enclosed in the system housing may include a steering system (e.g., with a steering motor 232) and a trim system (e.g., with a trim motor 242) in electrical and mechanical connection. FIG. 5A illustrates a first view of the system 200. In some embodiments, the system 200 may include a shaft attachment feature 225, a steering system 230 and a trim system 240.

In some embodiments, as illustrated in FIG. 5B, the trolling motor shaft attachment feature may include multiple components to define a pathway to receive the shaft of a trolling motor. The shaft attachment feature 225 may include an elongated body 226 to receive the shaft, extending through the system housing, and a steering gear 227 fixed about a bottom portion of the elongated body 226. In some embodiments, the steering gear 227 may be configured to surround a portion of the elongated body 226, (e.g., the steering gear 227 may be disc shaped). In some embodiments, the elongated body 226 may have a substantially circular circumference and the opening within the steering gear 227 may have a substantially similar circumference. Although the circumferences are described as being circular, the circumferences (or perimeters) of the elongated shaft and the steering gear opening may be of any appropriate shape.

In some embodiments, the opening within the disc shaped steering gear comprises at least one divot, and the elongated body 226 may have at least one corresponding divot such that the divots of the elongated body 226 and the steering gear 227 interlock as to rotate the shaft attachment feature 225 about the trolling motor shaft axis A1. In some embodiments, as seen in FIG. 6, the elongated body 226 may include at least one opening 231. In some embodiments, a belt 247 may pass through the at least one opening 231 to induce the shaft to move upward or downward along the trolling motor shaft axis A1.

The steering system may be designed to rotate the trolling motor to propel the watercraft in a desired direction. Returning to FIG. 5A, in some embodiments, the steering system 230 may include a steering motor 232, and a series of gears 234 configured to engage and rotate the shaft attachment feature 225 about the shaft axis A1. For example, the steering motor 232 may rotate in a first direction to move the series of gears 234 to engage the steering gear 227 to rotate the shaft attachment feature 225 about the shaft axis A1 to cause the trolling motor housing 115 to be positioned to a desired angular orientation in response to steering control signals provided by the processor 370, as discussed herein. Similarly, the steering motor 232 may rotate in a second direction opposite to the first to rotate the shaft attachment feature 225 in the opposite direction. In some embodiments, the series of gears 234 is a plurality of gears as shown in FIG. 5A, however any appropriate number of gears, or other mechanical connections would be apparent to one of skill in the art.

Trim systems are designed to raise and lower the trolling motor so as to adjust the height or distance between the trolling motor housing and the bottom surface of the body of water. Trimming of the trolling motor housing 115 may aid in preventing damage to the trolling motor housing 115 (such as due to objects in the underwater environment) and/or aid in placement of various sensors mounted on the trolling motor housing 115 at a desired depth (e.g., positioning a sonar system at a desired depth).

In some embodiments, with reference to FIGS. 5A-5E, the trim system 240 may include a trim module having a trim motor 242 configured to cause the trolling motor shaft to raise or lower with respect to the steering system, and to cause the trolling motor to raise or lower with respect to the watercraft. In some embodiments, the trim system may include a gear train 246. The gear train 246 may include a series of gears and belts, including for example, worm, spur, helical, double helical, spiral bevel, miter, straight bevel, internal, and/or rack and pinion gears. The gear train 246 may be disposed within the elongated body 226 of the shaft attachment feature 225 such that a component of the gear train physically interacts with the shaft 105 of the trolling motor 100. In an example embodiment, the trim motor 242 is configured to engage and rotate the gear train 246. For example, the trim motor 242 may rotate in a first direction to move a tooth belt gear system 244 to rotate the gear train in a first direction. Similarly, the trim motor 242 may rotate in a second direction opposite the first direction to rotate the gear train 246 in a second direction.

In some embodiments, the trim module is disposed on the shaft attachment feature 225, more specifically the trim module may be disposed on the steering gear 227 such that the trim module rotates about the trolling motor shaft axis A1 with the trolling motor shaft attachment feature 225.

FIG. 5C illustrates a second view of the system 200. The system 200 may further include at least one printed circuit board or other means for an electrical connection. In some embodiments, the printed circuit board 248 may be fixed to the housing of the gear train 246 while, in other embodiments, it may be located in another location. The printed circuit board 248 may provide sufficient power to the various components of the system 200.

FIG. 5D illustrates a bottom view of the system 200. In some embodiments, the steering gear 227 may include a guide path 228. The guide path 228 may be a continuous protrusion descending from a bottom face of the steering gear, creating a pathway for a cable, wire, or other connection device, while in other embodiments, the guide path 228 may be a series of discontinuous protrusions descending from the bottom face of the steering gear. In some embodiments, the guide path 228, as illustrated in FIG. 5D, may be spiraled on the bottom face, while in other embodiments other acceptable configurations are contemplated.

FIG. 5E illustrates a top perspective view of the system 200. In some embodiments, the trim system and the shaft attachment feature are configured such that the components of the trim system may be rotatable about the shaft axis A1 without interfering with other components within the system, for example, the steering motor.

A trim system enables vertical movement of a shaft in relation to the housing. FIG. 6 illustrates a cross sectional view of the system 200, showing the gear train 246 coupled within the shaft attachment feature 225. As illustrated, the gear train may include a belt 247 that contacts a portion of the shaft via at least one opening 231 in the elongated body 226. In some embodiments, the belt 247 is configured to rotate in response to rotation of the trim motor 242. For example, the trim motor 242 may rotate in a first direction to move a tooth belt gear system 244 to rotate the gear train in a first direction, which in turn rotates the belt 247 in a first direction. Similarly, the trim motor 242 may rotate in a second direction opposite the first direction to rotate the gear train 246, and the belt 247, respectively, in a second direction. The friction between the shaft and the belt 247 affords the vertical movement of the shaft with respect to the shaft attachment feature.

The system housing 220 may be shaped such that the trim system may rotate with the shaft attachment feature 225 within the system housing 220 in a manner where the components of the various systems do not interfere with each other upon rotation. The system housing 220 may further be shaped such as to surround the system 200 while being as small as possible to house the components adequately.

The system housing 220 is preferably waterproof. The shaft attachment feature 225 may further include two bearings, an upper bearing 229*a* and a lower bearing 229*b*. The bearings may be affixed about the elongated body 226 such that the elongated body 226 and steering gear 227 rotate within the bearing. The bearings may form a seal with the system housing 220 yielding a watertight interior.

FIG. 6 further illustrates a plurality of protrusions forming a guide path 228 on the bottom face of the steering gear 227. In some embodiments, the guide path 228 may have a height similar to that of the outer wall of the steering gear 227, while in other embodiments the height of the guide path is less than that of the outer wall of the steering gear. In some embodiments, the guide path may be on the upper face of the steering gear, or in another suitable location.

The system 200 may include an electrical connection between the steering system and the trim system. The electrical connection may be configured to withstand the rotation of the shaft attachment feature such that the connection is reliable and not easily broken. The electrical supply may originate from a power source outside of the system housing, such as a power supply within the watercraft. The connection may enter the system housing through an opening 122, as illustrated in FIG. 3. In some embodiments, the connection may allow for signals to be sent from the watercraft to the system to perform steering and/or trimming commands.

The use of a wired connection between the steering system and the trim system may allow for maximum flexibility in power and data transmission. A wired connection may provide both a higher power input, and a higher data transmission rate than other connections, e.g., a wiping contact connection. Further in some embodiments, conductor resistivity may be tailored to the uses of the system.

In a first example configuration, a cable may be spiraled below the steering gear and fed through an opening between the steering gear and the elongated body to the printed circuit board. As illustrated in FIG. 7A, the system 200 may include a cable 250 extending from an external source on a first end, to a spiral below the steering gear 227, through an opening between the steering gear 227 and the elongated body 226 to the printed circuit board 248. In some embodiments, as the shaft attachment feature 225 rotates the position of the cable within the guide path may fluctuate.

In some embodiments, the cable 250 may be a loosely spiral wound conductor. The conductor may be any acceptable cable, flexible printed circuit board, or the like. The cable 250 may electrically connect the printed circuit board 248 to an outside power source, and the cable 250 may further connect the printed circuit board 248 to a steering system printed circuit board, allowing electrical communication between the steering system and the trim system.

In some embodiments, the spiral wound cable may absorb the rotation of a portion of the trolling motor by becoming either more or less tightly wound within the guide path in response to the rotation of the shaft attachment feature in either direction. FIG. 7B illustrates a simplified bottom view of the steering gear 227 having a continuous guide path 228 descending from the bottom face of the steering gear. Stage A illustrates a relaxed cable 250, Stage B illustrates a neutral cable 250, and State C illustrates a tightly wound cable 250. As the stages progress from Stage A to C the steering gear is rotated counterclockwise, and the stages reverse when the steering gear 227 is rotated clockwise.

FIG. 7C is an exemplary bottom view of the system 200. The system shows the cable 250 wound about the guide path 228. In some embodiments, the cable 250 descends below an outer wall of the steering gear 227, below the steering motor 242 to a fixed connection outside of the system housing 220. In some embodiments, the cable 250 may have a split wherein a portion of the cable 250 connects to the steering motor 242 and a different portion of the cable connects outside of the system housing 220. As illustrated in FIG. 7C, the cable 250 does not interfere with the series of gears 234.

With reference to FIGS. 8A-8C, in another example configuration, the cable may be configured to rotate about an outer surface of the shaft attachment feature. FIG. 8A illustrates a first view of an example configuration of system 200', where the trim system 240' includes an upper portion 260 and a lower portion 262. Each of the upper portion 260 and lower portion 262 mostly surround the trim system 240'. For example, the lower portion 262 may comprise a wall 262*a* which extends upwards from the top surface of the steering gear 227'. The upper portion 260 may include an upper surface 260*a* of substantially similar shape to the steering gear disposed above the trim motor 242', wherein the surface rotates about the shaft axis A1 with the trim system 240'. The upper portion 260 may include a wall 260*a* descending from the upper surface 260*b*, having an outer surface. In some embodiments, the upper portion 260 and the lower portion 262 may be connected, while in other embodiments, the portions may be distinct from one another.

In some embodiments, with reference to FIG. 8A, the cable 250' may have an upper segment 252 having a first length $L_1$, a lower segment 254 having a second length $L_2$, and a middle segment 256 having a third length $L_3$. The upper segment 252 of the cable may be disposed at least partially about an exterior portion of the wall 260*a* of the upper portion of the trim housing, while the lower segment 254 of the cable 250 may be disposed at least partially about the outer surface 264*a* of the lower portion 264 of the trim housing. The middle segment 256 of the cable 250 may be configured to connect the upper segment 252 and the lower segment 254 of the cable 250' and may traverse the trim system 240' between the upper segment 252 and the lower segment 254.

FIG. 8B illustrates a second view of the example cable configuration of system 200'. In some embodiments, the lower portion 262 of the trim system may further include a retention path 264 disposed at least partially about the outer surface 262*a*. The retention path 264 may be configured to secure the cable 250' about the lower portion 262 of the trim system 240 such that the cable 250' remains flush with the lower portion 262.

In some embodiments, the cable "crawls" about the trim system as the shaft attachment feature rotates about the shaft axis. The cable may have a fixed total length, and be fixed on a first end outside of the system housing, for example, to a power source within the watercraft, and may be fixed on a second end within the system housing, for example, within the trim system. In some embodiments, the upper portion leads to the first end, and the lower portion is terminated in the second end. As the shaft attachment feature rotates, the cable 250' may crawl about the upper portion 260 and the lower portion 262, so as to maintain the length of the cable within the system housing, but enable rotation of the trolling motor attachment feature 225' and the trolling motor shaft (not shown). FIG. 8C illustrates three stages of the cable crawling about the shaft attachment feature. Stage A illustrates a first position wherein the first length $L_1$ is greater than the second length $L_2$. Stage B illustrates a second position wherein the first length $L_1$ and the second length $L_2$ are about equal. Stage C illustrates a third position of the shaft attachment feature wherein the second length $L_2$ is longer than the first length $L_1$. As the shaft attachment feature rotates about the shaft axis the third length $L_3$ of the middle segment 256 remains constant while the first length $L_1$ and second length $L_2$ are inversely proportional. Notably, in all cases, $L_1+L_2+L_3$=a constant length of the cable 250 even if two or more of $L_1$, $L_2$, or $L_3$ vary.

In some embodiments, the cable 250' may be reinforced with a wire, rigid outer coating, or similar to increase rigidity, such that the cable maintains the curvature of shaft attachment feature throughout the rotation.

Example System Architecture

FIG. 9 shows a block diagram of an example trolling motor system 300 capable for use with several embodiments of the present invention. As shown, the trolling motor system 300 may include a number of different modules or components, each of which may comprise any device or means embodied in either hardware, software, or a combination of hardware and software configured to perform one or more corresponding functions. For example, the trolling motor system 300 may include a main housing 310, a trolling motor housing 315, and a system housing 320. In some cases, the trolling motor system 300 may include a foot pedal housing 392.

The trolling motor system 300 may also include one or more communications modules configured to communicate with one another in any of a number of different manners including, for example, via a network. In this regard, the communication interface (e.g., 376) may include any of a number of different communication backbones or frameworks including, for example, Ethernet, the NMEA 2000 framework, GPS, cellular, WiFi, or other suitable networks. The network may also support other data sources, including GPS, autopilot, engine data, compass, radar, etc. Numerous other peripheral, remote devices such as one or more wired or wireless multi-function displays may be connected to the trolling motor system 300.

The main housing 310 may include a processor 370, a sonar signal processor 372, a memory 374, a communication interface 376, a user interface 378, a display 380, one or more sensors (e.g., location sensor 382, a position sensor 384, a motor sensor 388, etc.). Notably, the position sensor 384 and motor sensor 388 are shown in the trolling motor housing 315, although these sensors could be positioned elsewhere (such as in the main housing 310).

The processor 370 and/or a sonar signal processor 372 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 370 as described herein.

In this regard, the processor 370 may be configured to analyze electrical signals communicated thereto to provide display data to the display to indicate the direction of the trolling motor housing relative to the watercraft.

In some example embodiments, the processor 370 or sonar signal processor 372 may be configured to receive sonar data indicative of the size, location, shape, etc. of objects detected by the system 300 (e.g., via one or more sonar transducer assemblies 371). For example, the processor 370 may be configured to receive sonar return data and process the sonar return data to generate sonar image data for display to a user (e.g., on display 380 or a remote display).

In some embodiments, the processor 370 may be further configured to implement signal processing or enhancement features to improve the display characteristics or data or images, collect or process additional data, such as time, temperature, GPS information, waypoint designations, or others, or may filter extraneous data to better analyze the collected data. It may further implement notices and alarms, such as those determined or adjusted by a user, to reflect depth, presence of fish, proximity of other watercraft, etc.

The memory 374 may be configured to store instructions, computer program code, marine data, such as sonar data, chart data, location/position data, and other data associated with the sonar system in a non-transitory computer readable medium for use, such as by the processor.

The communication interface 376 may be configured to enable connection to external systems (e.g., an external network 390). In this manner, the processor 370 may retrieve stored data from a remote, external server via the external network 390 in addition to or as an alternative to the onboard memory 374.

The location sensor 382 may be configured to determine the current position and/or location of the main housing 310. For example, the location sensor 382 may comprise a GPS, bottom contour, inertial navigation system, such as micro electro-mechanical sensor (MEMS), a ring laser gyroscope, or the like, or other location detection system.

The display 380 may be configured to display images and may include or otherwise be in communication with a user interface 378 configured to receive input from a user. The display 380 may be, for example, a conventional LCD (liquid crystal display), an LED display, or the like. The display may be integrated into the main housing 310. In some example embodiments, additional displays may also be included, such as a touch screen display, mobile device, or any other suitable display known in the art upon which images may be displayed.

In any of the embodiments, the display 380 may be configured to display an indication of the current direction of the trolling motor housing 315 relative to the watercraft. Additionally, the display may be configured to display other relevant trolling motor information including, but not limited to, speed data, motor data battery data, current operating mode, auto pilot, or the like.

The user interface 378 may include, for example, a keyboard, keypad, function keys, mouse, scrolling device, input/output ports, touch screen, or any other mechanism by which a user may interface with the system.

The position sensor 384 may be found in one or more of the main housing 310, the trolling motor housing 315, or remotely. In some embodiments, the position sensor 384 may be configured to determine a direction of which the trolling motor housing is facing. In some embodiments, the position sensor 384 may be operably coupled to either the shaft or steering system 330, such that the position sensor 384 measures the rotational change in position of the trolling motor housing 315 as the trolling motor is turned. The position sensor 384 may be a magnetic sensor, a light sensor, mechanical sensor, or the like.

The trolling motor housing 310 may include a trolling motor 317, a sonar transducer assembly 371, and one or more other sensors (e.g., motor sensor 388, position sensor 384, water temperature, current, etc.), which may each be controlled through the processor 370 (such as detailed herein).

In some embodiments, the trolling motor system 300 may include a control system housing 320 that includes a trim system 340 and a steering system 330, such as described herein in various embodiments. Additionally, the control system housing 320 may include a trolling motor shaft attachment feature 327 that enables attachment to the shaft of the trolling motor. As noted herein, in some embodiments, the trim system 340 may be attached to the trolling motor shaft attachment feature 327 and configured to rotate therewith, such as in response to rotation imparted by the steering system 330.

In some example embodiments, the trolling motor system 300 may further include a foot pedal housing 392 that includes a foot pedal 394, a display 380', and a user interface 378', which may each be connected to the processor 370 (such as detailed herein). In this regard, the main housing 310 may not include the display 380 or user interface 378, as it is instead in the foot pedal housing 392 (though some embodiments contemplate inclusion of the display 380 and/or user interface 378 in the main housing).

In some embodiments, the trolling motor system 300 may include additional sensors, for example, a speed sensor, such as an electromagnetic speed sensor, paddle wheel speed sensor, or the like configured to measure the speed of the watercraft through the water.

In some embodiments, the trolling motor system 300 may include a motor sensor. The motor sensor may be a voltage sensor, a rotation per minute (RPM) sensor, a current sensor or other suitable sensor to measure the output of the trolling motor 317.

In some embodiments, the trolling motor system 300 may include a battery sensor. The battery sensor may include a current sensor or voltage sensor configured to measure the current charge of a battery power supply of the trolling motor system 300.

Example Flowchart(s) and Operations

Some embodiments of the present invention provide methods, apparatus, and computer program products related to the presentation of information according to various embodiments described herein. Various examples of the operations performed in accordance with embodiments of the present invention will now be provided with reference to FIG. 10.

FIG. 10 illustrates a flow chart according to an example method of steering and trimming a trolling motor according to an example embodiment. The operations illustrated in and described with respect to FIG. 10 may, for example, be performed by, with the assistance of, and/or under the control of one or more of the processor 370, trim system 340, steering system 330, sonar signal processor 372, memory 374, communication interface 376, user interface 378, location sensor 382, display 380, sonar transducer assembly 371, and/or position sensor 384.

The method for steering and trimming a trolling motor depicted in FIG. 10 may include providing a trolling motor assembly at operation 410, such as described herein. The method 400 may continue by causing the steering system to operate to cause the trolling motor shaft attachment feature and the shaft to change the facing direction of the trolling motor at operation 420. The method 400 may continue to by causing the trim to operate to cause the shaft to raise or lower with respect to the steering system so as to cause the trolling motor to raise or lower with respect to the watercraft at operation 430. In some embodiments, the order of operations with respect to operations 420 and 430 may be reversed and/or operations 420 and 430 may be performed simultaneously.

FIG. 10 illustrates a flowchart of a system, method, and computer program product according to an example embodiment. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 374 and executed by, for example, the processor 370. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A system for steering and trimming a trolling motor, the system comprising:

a trolling motor shaft attachment feature configured to receive and rotate with a trolling motor shaft about a trolling motor shaft axis;

a steering system comprising:

a steering motor configured to rotate the trolling motor shaft attachment feature and the trolling motor shaft to steer a facing direction of the trolling motor, wherein the steering motor comprises a first gear that is connected to a gear train; and a trim system comprising:

a trim module having a trim motor configured to cause the trolling motor shaft to raise or lower with respect to the steering system so as to cause the trolling motor to raise or lower with respect to a watercraft, wherein the trim module comprises a second gear that is connected to the gear train and that is disposed directly on the trolling motor attachment feature so as to drive the trolling motor attachment feature, wherein the trim module is disposed on the trolling motor shaft attachment feature such that the trim module rotates with the trolling motor shaft attachment feature about the trolling motor shaft axis.

2. The system of claim 1, wherein the steering system is in mechanical connection with the trolling motor shaft attachment feature.

3. The system of claim 1, wherein trim system is in electrical connection with the steering system.

4. The system of claim 1, further comprising a housing, wherein the housing encloses the trolling motor shaft attachment feature, the steering system, and the trim system, wherein the trolling motor shaft attachment feature is configured to rotate with the shaft within the housing.

5. The system of claim 4, further comprising a cable providing electrical connection between the trim system and a device or system external to the housing.

6. The system of claim 5, wherein the trolling motor shaft attachment feature further comprises a guide path for the cable.

7. The system of claim 6, wherein the guide path is disposed on a bottom face of the trolling motor shaft attachment feature, and the trim module is disposed on a top face of the trolling motor shaft attachment feature.

8. The system of claim 7, wherein the guide path is configured as a spiral.

9. The system of claim 8, wherein the cable is rotatable between a relaxed position and a tightened position, wherein rotation of the trolling motor shaft in a first direction tightens the cable and rotation in a second direction opposite to the first direction loosens the cable.

10. The system of claim 5, wherein the trim system comprises an upper outer surface about an upper portion of the trim system, and a lower outer surface about a lower portion of the trim system;

wherein the cable further comprises an upper segment disposed about the upper outer surface, a lower segment disposed about the lower outer surface, and a middle segment disposed between the upper outer surface and the lower outer surface, wherein the upper segment of the cable has a first length, the lower segment of the cable has a second length, and the middle segment of the cable has a third length, wherein the first length and the second length are inversely proportional, and the third length is constant as the trolling motor shaft attachment feature rotates.

11. The system of claim 10, wherein the cable comprises a rigid outer layer.

12. The system of claim 5, wherein the cable further provides electrical connection to the steering system.

13. A trolling motor assembly configured for attachment to a watercraft, the trolling motor assembly comprising:

a shaft having a first end and a second end defining a shaft axis extending between the first end and the second end;

a trolling motor at least partially contained within a trolling motor housing, wherein the trolling motor housing is attached to the second end of the shaft, wherein, when the trolling motor assembly is attached to the watercraft and the trolling motor housing is submerged in a body of water, the trolling motor, when operating, is configured to propel the watercraft to travel along the body of water;

a main housing connected to the shaft proximate the first end of the shaft, wherein the main housing is configured to be positioned out of the body of water when the trolling motor assembly is attached to the watercraft and the trolling motor housing is submerged in the body of water;

a trolling motor shaft attachment feature configured to receive and rotate with the shaft; and a steering system comprising:

a steering motor configured to rotate the trolling motor shaft attachment feature and the shaft to steer a facing direction of the trolling motor, wherein the steering motor comprises a first gear that is connected to a gear train; and a trim system comprising:

a trim module configured to cause the shaft to raise or lower with respect to the steering system so as to cause the trolling motor housing to raise or lower with respect to the watercraft, wherein the trim module comprises a second gear that is connected to the gear train and that is disposed directly on the trolling motor attachment feature so as to drive the trolling motor attachment feature, wherein the trim module is disposed on the trolling motor shaft attachment feature such that the trim module rotates with the trolling motor shaft attachment feature about the shaft axis.

14. The assembly of claim 13, further comprising a system housing, wherein the system housing encloses the trolling motor shaft attachment feature, the steering system and the trim system, wherein the trolling motor shaft attachment feature is configured to rotate with the shaft within the system housing.

15. The assembly of claim 14, wherein the system housing is watertight.

16. The assembly of claim 13, wherein the trolling motor shaft attachment feature comprises a spiral guide path disposed on an underside, and a cable is disposed within the spiral guide path configured to loosen and tighten within the spiral guide path as the trolling motor shaft attachment feature rotates about the shaft.

17. The assembly of claim 13, wherein the trim system comprises an upper outer surface about an upper portion of the trim system, and a lower outer surface about a lower portion of the trim system; and a cable disposed about the trim system, wherein the cable further comprises an upper segment disposed about the upper outer surface, a lower segment disposed about the lower outer surface, and a middle segment disposed between the upper outer surface and the lower outer surface, wherein the upper segment of the cable has a first length, the lower segment of the cable has a second length, and the middle segment of the cable has a third length, wherein the first length and the second length are inversely proportional, and the third length is constant as the trolling motor shaft attachment feature rotates.

18. A method for steering and trimming a trolling motor, the method comprising:

providing a trolling motor assembly configured for attachment to a watercraft, wherein the trolling motor assembly comprises:

a shaft having a first end and a second end defining a shaft axis extending between the first end and the second end;

a trolling motor at least partially contained within a trolling motor housing, wherein the trolling motor housing is attached to the second end of the shaft, wherein, when the trolling motor assembly is attached to the watercraft and the trolling motor housing is submerged in a body of water, the trolling motor, when operating, is configured to propel the watercraft to travel along the body of water;

a main housing connected to the shaft proximate the first end of the shaft, wherein the main housing is configured to be positioned out of the body of water when the trolling motor assembly is attached to the watercraft and the trolling motor housing is submerged in the body of water;

a trolling motor shaft attachment feature configured to receive and rotated with the shaft;

a steering system comprising:

a steering motor configured to rotate the trolling motor shaft attachment feature and the shaft to steer a facing direction of the trolling motor, wherein the steering motor comprises a first gear that is connected to a gear train; and a trim system comprising:

a trim module configured to cause the shaft to raise or lower with respect to the steering system so as to cause the trolling motor to raise or lower with respect to the watercraft, wherein the trim module comprises a second gear that is connected to the gear train and that is disposed directly on the trolling motor attachment feature so as to drive the trolling motor attachment feature, wherein the trim module is disposed on the trolling motor shaft attachment feature such that the trim module rotates with the trolling motor shaft attachment feature about the shaft axis;

causing the steering system to operate to cause the trolling motor shaft attachment feature and the shaft to change the facing direction of the trolling motor; and causing the trim system to operate to cause the shaft to raise or lower with respect to the steering system so as to cause the trolling motor to raise or lower with respect to the watercraft.

19. The method of claim 18, wherein the trolling motor assembly further comprises a system housing, wherein the system housing encloses the trolling motor shaft attachment feature, the steering system and the trim system, wherein the trolling motor shaft attachment feature is configured to rotate with the shaft within the system housing.

* * * * *